US005634212A

United States Patent [19]

Gilbert

[11] Patent Number: 5,634,212

[45] Date of Patent: Jun. 3, 1997

[54] DOUBLE BAG MITTEN FOR EXTREME COLD TEMPERATURES

[76] Inventor: Matthew J. Gilbert, 47 S. Seventh St., Indiana, Pa. 15701

[21] Appl. No.: 585,296

[22] Filed: Jan. 11, 1996

[51] Int. Cl.[6] ..... A41D 27/00; A41D 19/00

[52] U.S. Cl. ..... 2/158; 2/159; 2/163; 2/275

[58] Field of Search ..... 2/158, 159, 169, 2/275, 163

[56] References Cited

U.S. PATENT DOCUMENTS

| | | | |
|---|---|---|---|
| 1,006,510 | 10/1911 | Tabor | 2/158 |
| 1,053,204 | 2/1913 | Morrison | 4/158 |
| 1,280,421 | 10/1918 | Diem | 2/158 |
| 2,265,329 | 12/1941 | Wachs | 2/158 X |
| 2,283,561 | 5/1942 | Lindfelt | 2/158 |
| 2,391,263 | 12/1945 | Morton | 2/158 X |
| 2,445,987 | 7/1948 | Ashman . | |
| 2,460,413 | 2/1949 | Errett | 2/158 |
| 2,735,108 | 2/1956 | Cremer | 2/158 |
| 3,114,915 | 12/1963 | Gross | 2/158 |
| 3,403,408 | 10/1968 | Helfer . | |
| 5,167,038 | 12/1992 | Rinehart | 2/169 X |
| 5,343,566 | 9/1994 | Solheim et al. | 2/169 |
| 5,442,818 | 8/1995 | Loos | 2/169 X |

*Primary Examiner*—Amy B. Vanatta
*Assistant Examiner*—Shirra L. Jenkins
*Attorney, Agent, or Firm*—Joseph T. Guy, Jr.

[57] ABSTRACT

A mitten for maintaining hand warmth in extreme temperature is described as well as a method for manufacturing the mitten without the necessity for molding. The mitten comprises a hand shaped upper outer shell comprising a cuff region and a finger region comprising a thumb receiving section and a finger receiving section; a hand shaped upper inner shell comprising a cuff region and a finger region comprising a thumb receiving section and a finger receiving section; a hand shaped lower inner shell comprising a cuff region and a finger region comprising a thumb receiving section and a finger receiving section; a hand shaped lower outer shell comprising a cuff region and a finger region comprising a thumb receiving section and a finger receiving section; an interface; a first insulating material between the upper outer shell and the upper inner lining; and a second insulating material between the lower inner lining and the lower outer shell; the finger region of the upper outer shell, the finger region of the lower outer shell and the interface are attached at an outer seam and the finger region of the upper inner shell, the finger region of the lower inner shell and the interface are attached at an inner seam.

16 Claims, 8 Drawing Sheets

DOUBLE BAG MITTEN FOR EXTREME COLD TEMPERATURES

BACKGROUND OF THE INVENTION

This invention relates generally to wearing apparel and more specifically to a mitten which is ideally suited for cold temperatures and a method for making the mitten.

The use of mittens to maintain hand warmth in cold temperatures is well known in the art, yet mittens of the art are still lacking in their ability to maintain hand warmth in extreme cold temperatures (i.e. less than 0° C.) for extended periods of time. One problem with prior art mittens is the presence of at least one seam which contacts both the interior of the mitten and the exterior of the mitten. These seams are referred to as exposed seams and the exposed seams are responsible for some loss of heat. Any loss of heat eventually allows the air inside the mitten to cool which subsequently leads to a cooling of the hand.

One way to avoid the problem of exposed seams is to construct a mitten without external seams as provided in U.S. Pat. No. 2,735,108. This process is expensive since the glove must be molded. It is well accepted in the art that a glove which can be sewn is typically less expensive to manufacture than a molded glove. Most modern fabrics and synthetic materials have temperature insulating properties which are far superior to most molded materials yet they do not readily lend themselves to a molding process.

Another mitten with a seamless exterior is provided in U.S. Pat. No. 1,053,204 yet this mitten is hardly suitable for practical use as a mitten for warmth. A user could hardly apply the second mitten and inflate without some assistance. The mitten described would also be difficult to manufacture since both the inner and outer shells would require molding.

Two mittens may be used together as described in U.S. Pat. Nos. 5,343,566 and 1,280,421 wherein one mitten is inserted into the second mitten. Insulating material could be inserted between the outer mitten and the inner mitten yet there is no method described to keep the inner mitten from coming into contact with the outer mitten. In extreme cold temperatures the outer mitten becomes cold from contact with the air and if the inner mitten and outer mitten come into contact the temperature of the inner mitten will be decreased. Furthermore, when the hand is withdrawn the inner mitten is frequently pulled out of the outer mitten. U.S. Pat. No. 5,343,566 takes advantage of this fact since the interior of the glove can be dried in this manner. U.S. Pat. No 1,280,421 avoids this problem by stitching the inner and outer mittens together at the extreme end of the palm portion which forms an exposed seam.

U.S. Pat. No. 2,460,413 illustrates a welders mitten wherein the seam is moved to the outside and a liner is used. This mitten is designed for use when welding and is not suitable for cold weather use.

The present invention solves the problems of the prior art by providing a mitten which can be filled with insulating material, has no exposed seams around the fingers, and can be manufactured with conventional sewing techniques. Furthermore, the mitten of the present invention will not have a lining pull out of the exterior portion when the mitten is removed.

SUMMARY OF THE INVENTION

It is an object of the present invention to provide a mitten which is suitable for use in extreme cold weather for extended periods of time.

It is another object of the present invention to provide a mitten which does not have any exposed seams yet is easily manufactured by standard sewing techniques.

A particular feature of the present invention is the ability of the interior of the mitten not to separate from the exterior when the mitten is removed keeping the integrity of the insulation and shape intact.

Yet another feature is the ability to manufacture the glove with natural materials, or synthetic materials without the necessity for molding.

These and other advantages, as will become apparent from the description herein, are provided in a mitten for maintaining hand warmth in extreme temperature comprising: a hand shaped upper outer shell comprising a cuff region and a finger region comprising a thumb receiving section and a finger receiving section; a hand shaped upper inner shell comprising a cuff region and a finger region comprising a thumb receiving section and a finger receiving section; a hand shaped lower inner shell comprising a cuff region and a finger region comprising a thumb receiving section and a finger receiving section; a hand shaped lower outer shell comprising a cuff region and a finger region comprising a thumb receiving section and a finger receiving section; an interface; a first insulating material between said upper outer shell and said upper inner lining; and a second insulating material between said lower inner lining and said lower outer shell; wherein said finger region of said upper outer shell, said finger region of said lower outer shell and said interface are attached at an outer seam and said finger region of said upper inner shell, said finger region of said lower inner shell and said interface are attached at an inner seam.

Yet another embodiment of the inventive double bag mitten is provided in a mitten for maintaining hand warmth in extreme temperature comprising: a first hand shaped bag comprising an outer shell and an inner liner and insulating material between said outer shell and said inner liner; a second hand shaped bag comprising a second outer shell and a second inner liner and insulating material between said second outer shell and said second inner liner; an interface between said first hand shaped bag and said second hand shaped bag wherein said interface is attached to said outer shell and said second outer shell at an outer seam and said interface is attached to said inner liner and said second inner liner at an inner seam with the proviso that said inner seam and said outer seam are separated by said interface.

A preferred method for making the inventive double bag mitten is provided in A process for forming a double bag mitten comprising the steps of: overlaying a first hand shaped blank and a second hand shaped blank wherein said first hand shaped blank and said second hand shaped blank comprise a cuff region and a finger region comprising a thumb section and a finger section; overlaying a third hand shaped blank and a fourth hand shaped blank wherein said third hand shaped blank and said fourth hand shaped blank comprise a cuff region and a finger region comprising a thumb section and a finger section; attaching said first hand shaped blank to said second hand shaped blank at said finger regions thereby forming a first bag comprising a finger region; attaching said third hand shaped blank to said fourth hand shaped blank at said finger regions thereby forming a second bag comprising a finger region; inserting first insulating material between said first hand shaped blank and said second hand shaped blank; inserting second insulating material between said third hand shaped blank and said fourth hand shaped blank; attaching said cuff region of said first hand shaped blank to said cuff region of said second hand shaped blank; attaching said cuff region of said third hand shaped blank to said cuff region of said fourth hand shaped blank; overlaying said first bag and said second bag such that said second hand shaped blank and said third hand shaped blank are in contact; attaching said finger region of said first bag to said finger region of said second bag at an inner seam forming a mitten with a thumb receiving section and a finger receiving section; pushing said inner seam inward towards said finger receiving section of said mitten; attaching said first hand shaped blank to said fourth hand shaped blank at an outer seam such that said inner seam is inward of said outer seam.

DETAILED DESCRIPTION OF THE INVENTION

Throughout the following description similar elements are numbered accordingly. Lower case letters indicate a multiplicity of similar elements for convenience.

Figure 1:
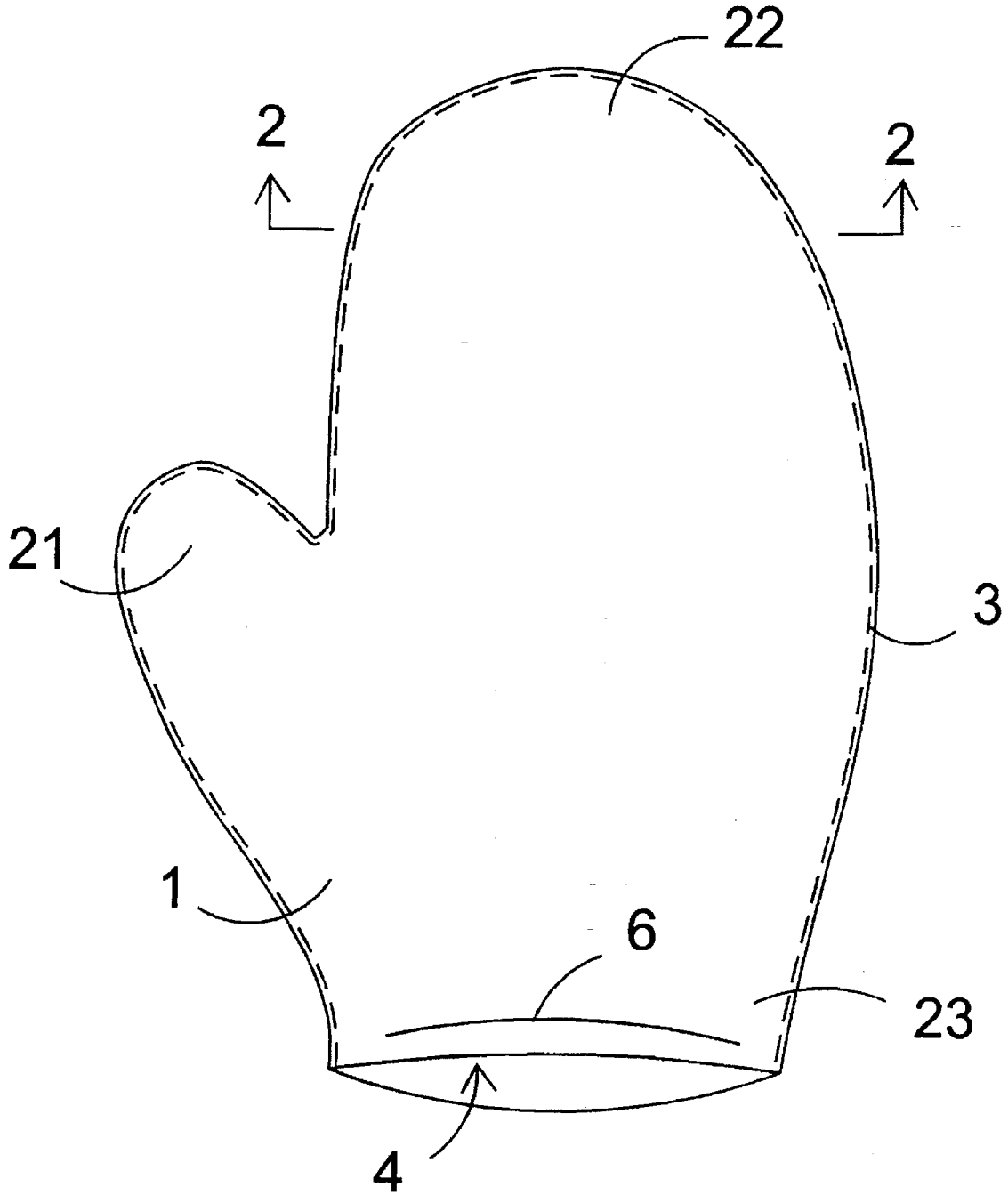
FIG. 1 is a perspective view of a hand shaped single bag.
Figure 2:
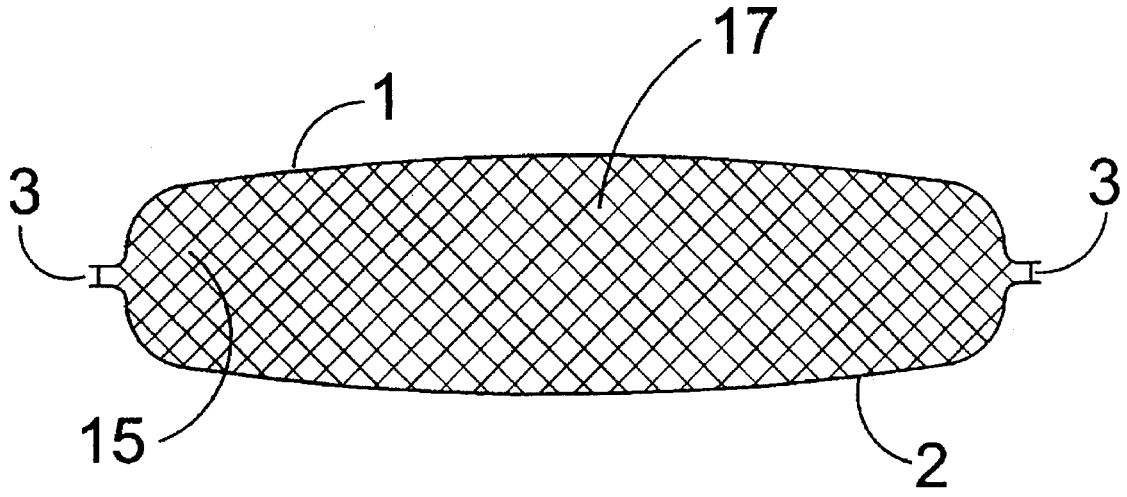
FIG. 2 is a cross-sectional view of the single bag taken along line 2—2 of FIG. 1.

FIGS. 1 shows a single bag as used in a preferred method of preparing the double bag mitten. The single bag of FIG. 1 is hand shaped with a cuff region, 23, and a finger region comprising a thumb receiving section, 21, and a finger receiving section, 22. FIG. 2 shows a cross-sectional view of the single bag taken along line 2—2 of FIG. 1. In FIG. 1 an outer shell, 1, shaped like a mitten, and a inner liner, 2, shaped approximately the same as the outer shell are overlaid and attached along a first sew line, 3. The outer shell and inner liner form an insulating chamber, 17, with an access, 4. The access may be used for fitting the insulating chamber with insulating material, 5, after which the insulating chamber is sealed along the second sew line, 6, thereby forming a single bag enclosing insulating material. The sides closest to, and parallel to, the first sew line are referred to as the finger sides and the side closest to, and parallel to the second sew line is referred to as the cuff region. The first sew line, 3, draws the outer shell and inner liner together to form a ledge, 7, around the periphery of finger region of the single bag. A pair of matching single bags are used in tandem to form the inventive double bag mitten as further described below. Alternatively, the outer shell, and inner liner, may be a single piece of material wherein a fold line replaces the first sew line at the intersection of the outer shell and inner liner.

Figure 3:
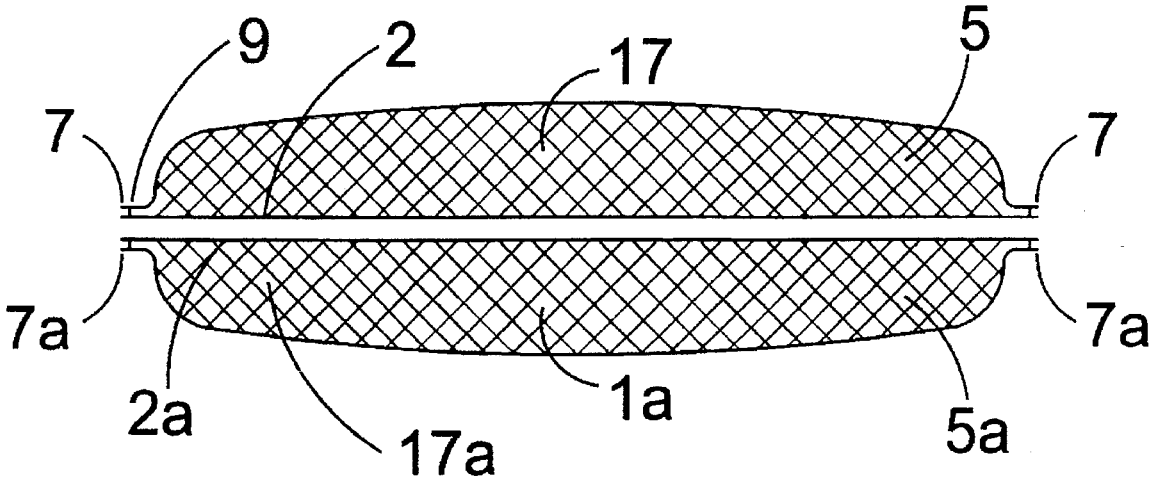
FIG. 3 is a cross-sectional view of a pair of single bags attached together to form a mitten.

FIG. 3 shows a cross-sectional view of two single bags overlaid. In FIG. 3, the upper outer shell, 1, lower outer shell 1*a*, upper inner liner 2, and lower inner liner 2*a*, are as shown in FIGS. 1 and 2. The ledges, 7 and 7*a*, along the finger sides of the single bags are sewn at an inner seam, 9. The cuff region of the two single bags are not attached since this forms the opening for receiving the hand. The two single bags sewn together form a mitten which is representative of the prior art.

The arrangement described and shown in FIG. 3 can be similarly obtained by overlaying four hand shaped blanks corresponding to the upper outer shell, upper inner liner, lower inner liner and lower outer shell in sequence and sewing along inner seam, 9. Insulating material could then be inserted between the upper outer shell, 1, and upper inner liner, 2. Likewise, insulating material could be inserted between the lower inner liner, 2*a*, and lower outer shell, 1*a*. The cuff region can then be closed by sewing the cuff region of the upper outer shell, 1, and upper inner liner, 2, to form a first bag. The cuff region of the lower inner liner, 2*a*, and lower outer shell, 1*a*, can also be sewn together to form a second bag.

Figure 4:
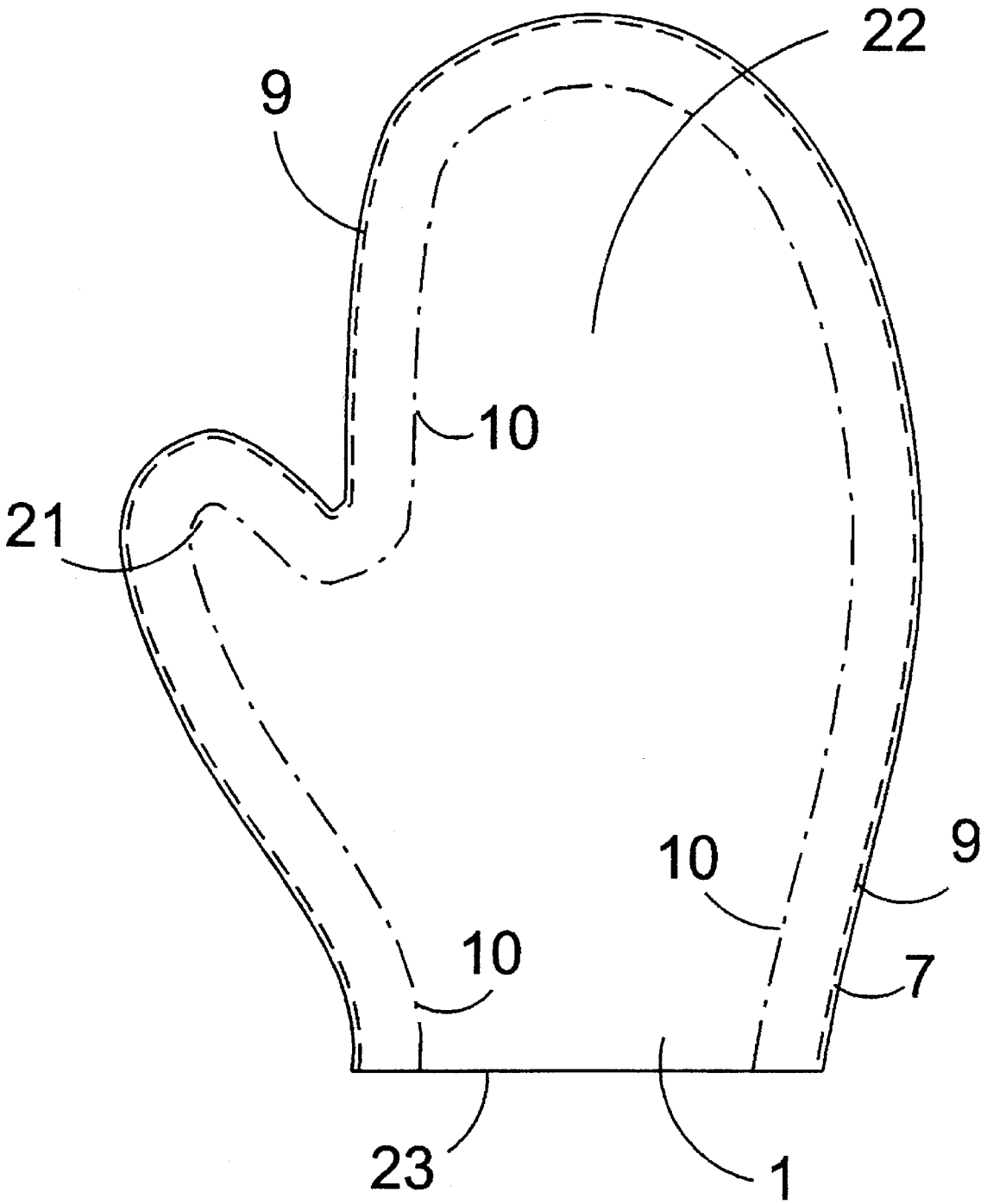
FIG. 4 is a plan view of the pair of single bags illustrating sew lines and fold lines.

FIG. 4 shows a top view of the mitten of FIG. 3. In FIG. 4 the outer shell, 1, inner seam, 9, and ledge, 7, are as described previously. The inventive double bag mitten is prepared by pushing the ledge, 7, towards the interior of the mitten such that the inner seam, 9, is interior to the fold line, 10. The fold line, 10, of the upper outer shell, 1, is sewn to the fold line, 10*a*, of the lower outer shell, 1*a*, further described with reference to, and shown in FIGS. 5 and 6.

Figure 5:
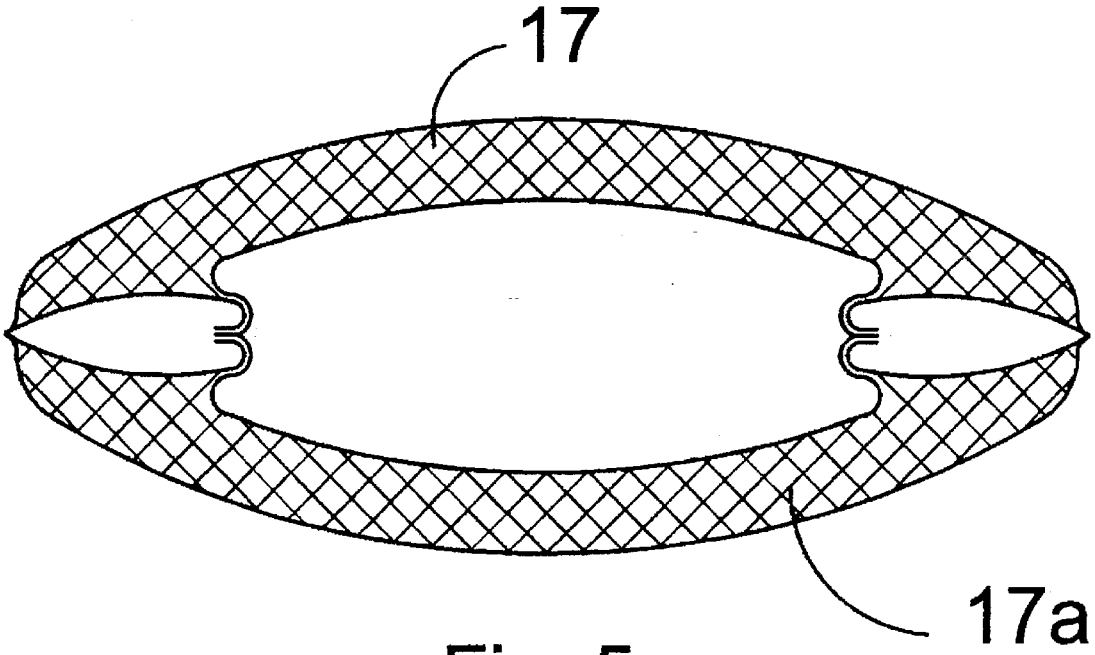
FIGS. 5 and 6 respectively, are cross-sectional views of the inventive mitten and an enlarged view of the cross-section of the sewn edge of the inventive mitten.

FIG. 5 shows a cross-sectional view of the inventive double bag mitten after the ledge, 7, has been pushed towards the interior of the mitten and the fold lines, 10, have been sewn together.

Figure 6:
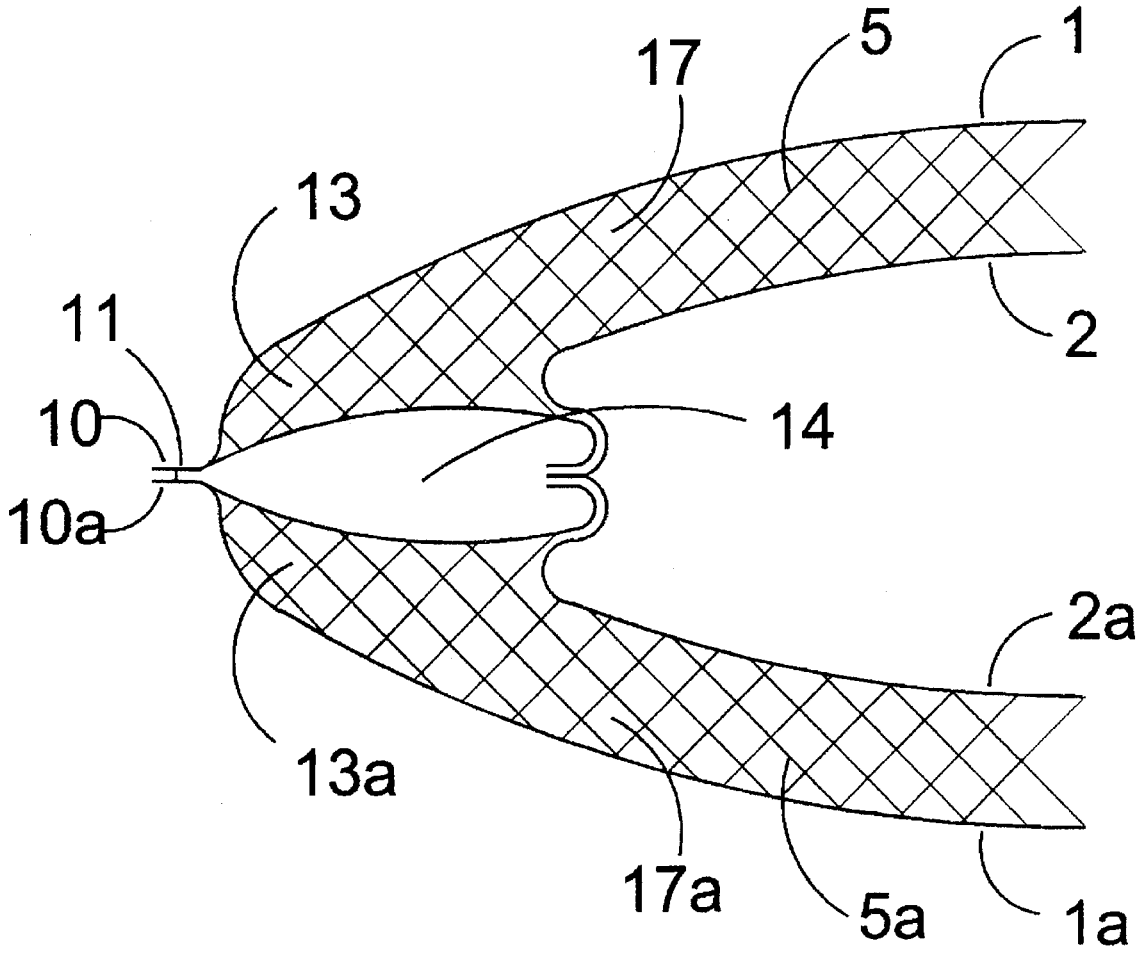

FIG. 6 shows a detailed view of the edge of an inventive double bag mitten. In FIGS. 5 and 6 the outer seam, 11, results from the joining of the two single bags at, or near, the upper fold line, 10 and lower fold line, 10*a*. The joined ledges, 7, 7*a*, are on the interior, 12, of the mitten and the insulating material, 5, 5*a*, surrounds the entire interior of the mitten. The portion of the upper outer shell, 1, and lower outer shell, 1*a*, between the outer seam, 10, and the inner seam, 9, is the interface, 13, between the upper insulating chamber, 17 and the lower insulating chamber, 17*a*. In FIG. 6, the interface, 13, comprises a cavity, 14. It is preferred that the cavity is filled with insulating material and most preferably the cavity is filled with the same insulating material as the two single bags for manufacturing convenience.

Figure 7:
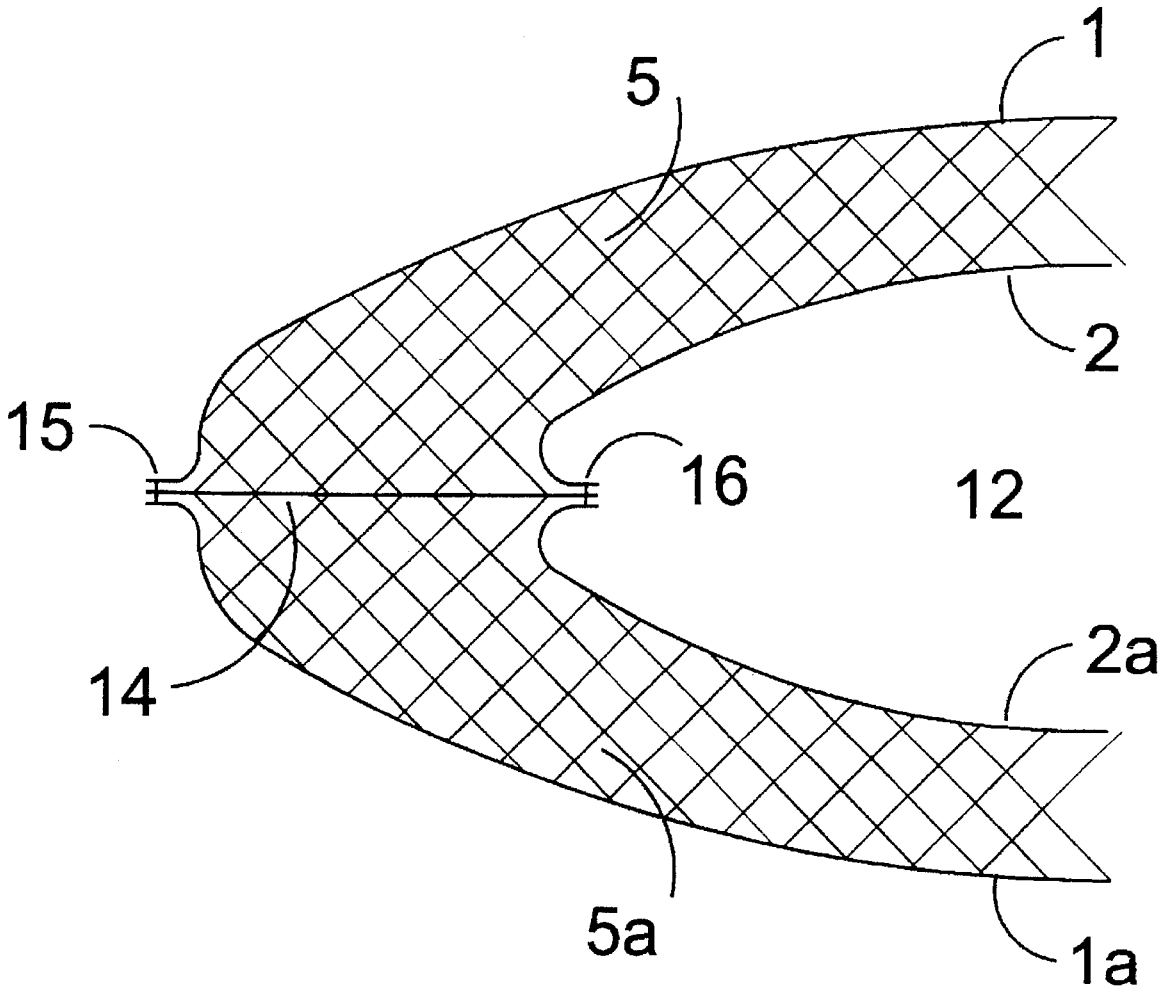
FIG. 7 is an enlarged view of the cross-section of another embodiment of the inventive mitten.

FIG. 7 shows a cross-sectional view of another embodiment of the present invention wherein the interface, 13, consist of an interface membrane, 14, which is a single thickness piece of material sewn at an inner seam, 16, to the upper inner liner, 2, and lower inner liner, 2*a*. The membrane, 14, is also sewn at an outer seam, 15, to the upper outer shell, 1, and the lower outer shell, 1*a*. The interface membrane eliminates the cavity and decreases the amount of material required to manufacture the double bag mitten.

Figure 8:
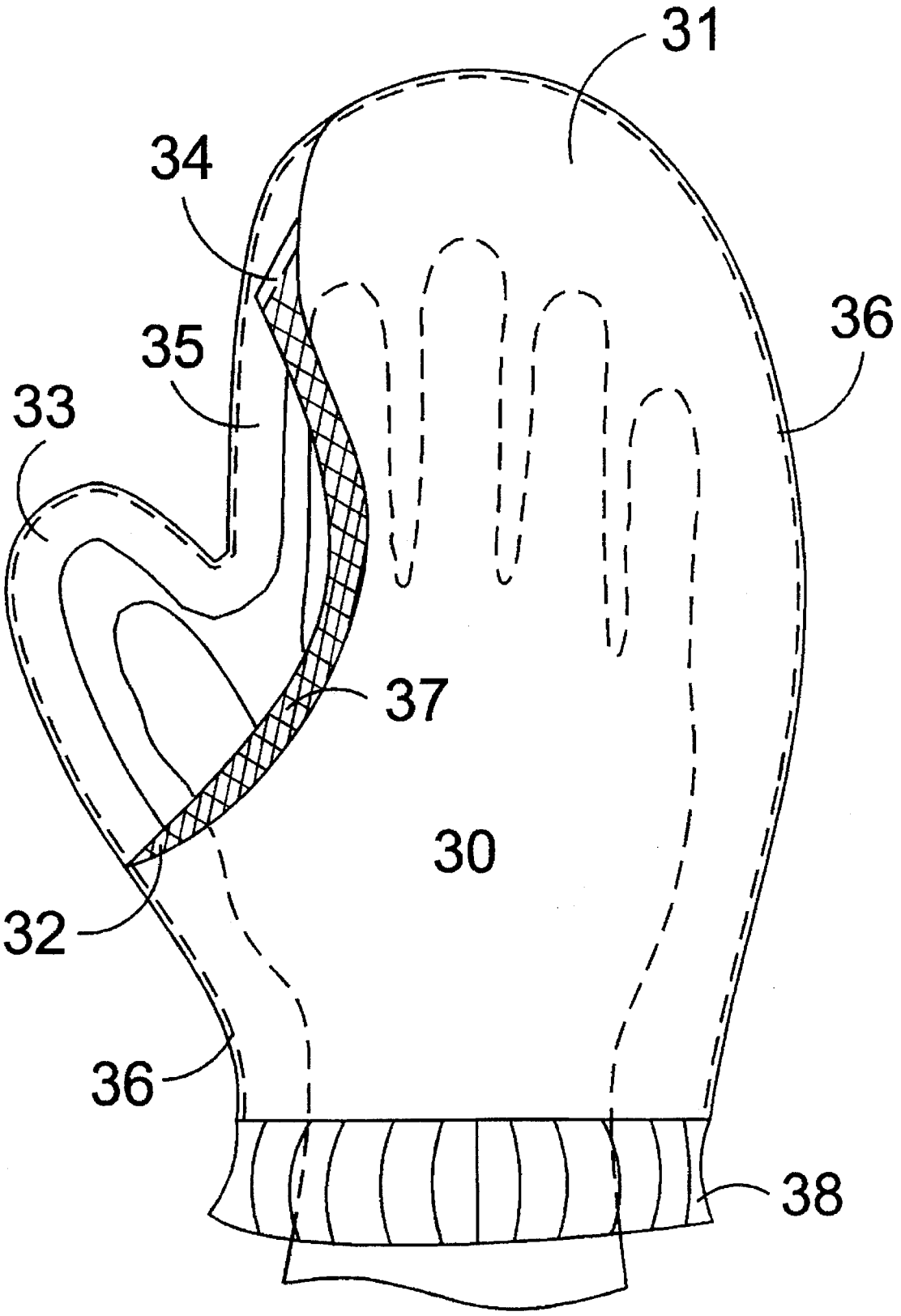
FIG. 8 is a partial cut-away view of the inventive double bag mitten.

FIG. 8 is a partial cut-away view of the inventive double bag mitten. In FIG. 8 a hand, 30, is in the interior of the mitten with the fingers in the larger finger receiving section and the thumb is in the thumb receiving section. The upper outer shell, 31, and upper inner lining, 32, are above the hand as illustrated. The lower inner lining, 33, and lower outer shell, not shown, are below the hand as illustrated. The upper inner lining, 31, and lower inner lining, 33, are attached to the interface, 35, at the inner seam, 34. The upper outer shell, 31 and lower outer shell, not shown, are attached to the interface, 35, at the outer seam, 36. Insulating material, 37, is between the upper outer shell, 31, and upper inner lining, 32. Insulating material is also between the lower outer shell and lower inner lining but is not shown here. An optional, but preferred tubular elastic cuff sleeve, 38, is attached to the cuff region of the mitten to discourage cold air from entering into the interior the mitten from the cuff.

It would be apparent from the description that the inner liner and outer shell can be reversed by simply turning the mitten inside to the outside and vice versa. This would be alter the aesthetic appearance since both the outer seam and the inner seam would not be readily observable.

The term "mitten" is a commonly used term to describe a glove with a cuff to receive the hand, a larger portion to receive the four fingers of the hand and a smaller portion to receive the thumb of the hand. Typically the hand is inserted into the cuff with the four fingers together and the thumb extended such that the four fingers go directly into the larger portion of the glove and the thumb goes directly into the smaller portion of the glove. Mittens are typically interchangeable between the right and left hand.

Insulating material is well known in the art. Preferred insulating material is either natural, such as wool, cotton or down from a fowl; or synthetic polymers, such as NYLON, THINSULATE, LYCRA, and the like. The total amount of insulating material in the mitten is at least about 0.1 gram, preferably 15 to 200 grams and most preferably 20 to 60 grams. The amount of insulation is chosen based on the temperature range within which the mittens will be worn. More insulation is required for colder temperatures. Above approximately 200 grams the mittens become so large that they are impractical. Below about 1 gram the insulation is insufficient to maintain hand warmth.

The outer shell and inner liner may be constructed of identical material or they may be different. The choice of material for the outer shell and inner liner is chosen based on the environment in which the mittens will be used. Preferably the outer shell is chosen from a material which is water resistant and typically these materials are synthetic polymeric materials, such as GORETEX, or rubberized material. Particularly preferred materials for use as a outer shell comprise NYLON, cotton, wool, GORETEX, leather, DACRON, or blends of two or more materials. Preferably, the inner liner is chosen for comfort since the inner liner will be in contact with the hand. Particularly preferred for the inner liner is wool or cotton.

I claim:

1. A mitten for maintaining hand warmth in extreme temperature comprising:

a hand shaped upper outer shell comprising a cuff region and a finger region comprising a thumb receiving section and a finger receiving section;

a hand shaped upper inner shell comprising a cuff region and a finger region comprising a thumb receiving section and a finger receiving section;

a hand shaped lower inner shell comprising a cuff region and a finger region comprising a thumb receiving section and a finger receiving section;

a hand shaped lower outer shell comprising a cuff region and a finger region comprising a thumb receiving section and a finger receiving section;

an interface;

a first insulating material between said upper outer shell and said upper inner shell; and a second insulating material between said lower inner shell and said lower outer shell;

wherein said finger region of said upper outer shell, said finger region of said lower outer shell and said interface are attached at an outer seam said finger region of said upper outer shell, said finger region of said lower outer shell, said finger region of said upper inner shell, said finger region of said lower inner shell and said interface are attached at said inner seam.

2. The mitten of claim 1 wherein said upper outer shell and said lower outer shell are identical materials.

3. The mitten of claim 1 wherein said first insulating material and said second insulating material combined weighs at least 1 gram.

4. The mitten of claim 3 wherein said first insulating material and said second insulating material combined weighs at least 15 grams and no more than 200 grams.

5. The mitten of claim 4 wherein said first insulating material and said second insulating material combined weighs at least 20 grams and no more than 60 grams.

6. The mitten of claim 1 wherein said upper outer shell or said lower outer shell comprise a material chosen from a set consisting of nylon, cotton, wool and leather.

7. The mitten of claim 1 wherein said upper inner shell or said lower inner shell is a material chosen from a set consisting of wool, cotton and nylon.

8. The mitten of claim 1 wherein said first insulating material or said second insulating material is chosen from a set consisting of wool, cotton, down, and synthetic polymers.

9. A process for forming a double bag mitten comprising the steps of:

overlaying a first hand shaped blank and a second hand shaped blank wherein said first hand shaped blank and said second hand shaped blank comprise a cuff region and a finger region comprising a thumb section and a finger section;

overlaying a third hand shaped blank and a fourth hand shaped blank wherein said third hand shaped blank and said fourth hand shaped blank comprise a cuff region and a finger region comprising a thumb section and a finger section;

attaching said first hand shaped blank to said second hand shaped blank at said finger regions thereby forming a first bag comprising a finger region;

attaching said third hand shaped blank to said fourth hand shaped blank at said finger regions thereby forming a second bag comprising a finger region;

inserting first insulating material between said first hand shaped blank and said second hand shaped blank;

inserting second insulating material between said third hand shaped blank and said fourth hand shaped blank;

attaching said cuff region of said first hand shaped blank to said cuff region of said second hand shaped blank;

attaching said cuff region of said third hand shaped blank to said cuff region of said fourth hand shaped blank;

overlaying said first bag and said second bag such that said second hand shaped blank and said third hand shaped blank are in contact;

attaching said finger region of said first bag to said finger region of said second bag at an inner seam forming a mitten with a thumb receiving section and a finger receiving section;

pushing said inner seam inward towards said finger receiving section of said mitten;

attaching said first hand shaped blank to said fourth hand shaped blank at an outer seam such that said inner seam is inward of said outer seam.

10. The process for forming a double bag mitten in claim 9 wherein said first hand shaped blank and said fourth hand shaped blank are identical materials.

11. The process for forming a double bag mitten in claim 9 wherein said first insulating material and said second insulating material combined weighs at least 1 gram.

12. The process for forming a double bag mitten in claim 11 wherein said first insulating material and said second insulating material combined weighs at least 15 grams and no more than 200 grams.

13. The process for forming a double bag mitten in claim 12 wherein said first insulating material and said second insulating material combined weighs at least 20 grams and no more than 60 grams.

14. The process for forming a double bag mitten in claim 9 wherein said second hand shaped blank or said third hand shaped blank is a material chosen from a set consisting of wool and cotton.

15. The process for forming a double bag mitten in claim 9 wherein said first insulating material or said second insulating material is chosen from a set consisting of wool, cotton, and synthetic polymers.

16. A mitten for maintaining hand warmth in extreme temperature comprising:

a first hand shaped bag comprising an outer shell and an inner liner and insulating material between said outer shell and said inner liner;

a second hand shaped bag comprising a second outer shell and a second inner liner and insulating material between said second outer shell and said second inner liner;

an interface between said first hand shaped bag and said second hand shaped bag wherein said interface is attached to said outer shell and said second outer shell at an outer seam and said interface is attached to said inner liner and said second inner liner at an inner seam with the proviso that said inner seam and said outer seam are separated by said interface wherein a finger region of said outer shell, a finger region of said second outer shell, a finger region of said inner liner, a finger region of said second inner liner and said interface are attached at said inner seam.

* * * * *